United States Patent [19]

Terry

[11] 4,185,692

[45] Jan. 29, 1980

[54] UNDERGROUND LINKAGE OF WELLS FOR PRODUCTION OF COAL IN SITU

[75] Inventor: Ruel C. Terry, Denver, Colo.

[73] Assignee: In Situ Technology, Inc., Denver, Colo.

[21] Appl. No.: 924,849

[22] Filed: Jul. 14, 1978

[51] Int. Cl.[2] ..... E21B 43/24

[52] U.S. Cl. ..... 166/257; 166/259; 166/261; 166/302

[58] Field of Search ..... 166/117.5, 117.6, 257, 166/259, 261, 262, 263, 271, 272, 302, 307; 48/DIG. 6; 175/12; 299/2, 14

[56] References Cited

U.S. PATENT DOCUMENTS

| | | | |
|---|---|---|---|
| Re. 21,668 | 12/1940 | Carroll | 166/117.6 X |
| 2,014,805 | 9/1935 | Hinderliter | 166/117.6 X |
| 3,017,168 | 1/1962 | Carr | 299/2 |
| 3,856,084 | 12/1974 | Parsons | 166/257 |
| 3,952,802 | 4/1976 | Terry | 166/262 |
| 4,010,801 | 3/1977 | Terry | 166/261 |
| 4,042,026 | 8/1977 | Pusch | 166/258 |
| 4,122,897 | 10/1978 | Capp et al. | 166/259 X |

*Primary Examiner*—Stephen J. Novosad
*Assistant Examiner*—George A. Suchfield

[57] ABSTRACT

In preparation for producing coal in situ two or more production wells are linked together through the coal seam by burned channels created by one or more blind hole burns.

14 Claims, 3 Drawing Figures

UNDERGROUND LINKAGE OF WELLS FOR PRODUCTION OF COAL IN SITU

BACKGROUND OF INVENTION

This invention relates to production of coal in situ wherein vertical wells are drilled into an underground coal seam, the walls are linked together through the coal to form reaction zones and the coal is produced as gases and liquids. The invention more particularly is directed to methods of accomplishing the linkage channels through the coal.

It is well known in the art how to produce coal in situ, the most common method being to set the coal afire underground, with the fire sustained by continuous injection of an oxidizer. By proper control of the oxidizer, a reducing environment is established in the reaction zone in the coal with the resultant generation of combustible gases. If air is used as the oxidizer, produced combustible gases generally range from about 80 to 200 BTU per standard cubic foot.

In the early experiments with burning coal in situ, shafts were excavated from the surface of the earth to the bottom of the underground coal seam. Channels were then dug through the coal to provide communication with at least two shafts. Workmen ignited the coal face and then evacuated to the surface. The fire was propagated by injecting an oxidizer such as air into one shaft and removing the products of reaction from the second shaft. In this manner a low BTU gas was generated with a heat content in the order of 150 BTU per standard cubic foot. As the burning proceeded and the linkage channel became larger, the heat content of the generated gases would become lower and lower due to oxygen bypass of the burning face. A part of the injected oxidizer would be consumed in the fire and a part would proceed to the exit shaft where the hot low BTU gas would be further burned. In severe cases the resulting flue gases would have a heat content too low for combustion and were therefore useless as a fuel gas.

One of the prime objectives of early experiments in producing coal in situ was to minimize the time workmen were required underground. After many years of experimentation it became apparent that underground workmen would not be required if wells were drilled into the coal seam. This raised the problem of how to link the wells together with a communication passage through the seam. Through the years various linkage schemes were tried including hydraulic fracturing, directional drilling, explosive fracturing, electro-linking using electrical current, various methods of burning the channel and the like.

More experimental work on linkage has been performed in Russia than the combined experimental work done in the other countries of the world. The Russian technicians have perfected a reliable method of linkage using a reverse burn between two or more vertical wells. A detailed description of the successful linking procedure may be found in U.S. Pat. No. 4,036,298 of Kreinin et al. In its elementory form the Russian procedure provides for two wells drilled to the bottom of the coal seam. High pressure air is injected into a first well and hot ignition material is placed into a second well. The air injected into the first well will migrate radially outward and a portion of the air will reach the second well, causing ignition of the coal seam and propagation of the underground fire through the coal seam towards the on coming oxygen supply. The air passing through the coal seam proceeds through paths of least resistance, a path that is unknown to the operator except in the most general sort of way. Thus the channel burned as the fire proceeds from the ignition well to the injector well is always something other than a straight line, and often is a path quite circuitous in nature. As long as the burned channel remains near the bottom of a flat coal seam, straightness of the path is not a critical consideration. Should the burned channel have significant deviations in a vertical direction, difficult operating problems will arise later in the production cycle due to flame override.

Linked vertical wells using the Russian procedures work exceptionally well when there is a thin parting in the coal near the bottom of the seam. In this case the oxidizer release point is established in the coal below the parting and the burned channel is thus restrained from migrating upward. Once the reaction zone is well established from the burned channel, the parting is broken by generated heat and roof fall, and the seam is consumed from the bottom up.

In the Russian procedure the linkage burn proceeds as a reverse burn, that is, the burn moves in an opposite direction from the direction of flow of the oxidizer. Once the channel burns through to the oxidizer injection well, permeability to the flow of gases is greatly increased, injection pressure drops significantly and the burn reverses itself and proceeds as a forward burn away from the injection well. In this manner a reaction zone is established in the coal with an oxidizer injected into one well and the products of reaction withdrawn from a second well.

In and around the reaction zone three significant environments are established. At the fire face the environment is highly oxidizing, down stream away from the fire a shortage of oxygen establishes a reducing environment, and the coal adjacent to the fire is subjected to a pyrolyzing environment. In the oxidizing environment coal is consumed and converted into carbon dioxide, sulfur dioxide and water vapor, gases that have little use except for their sensible heat. At these gases proceed down stream into the reducing environment the carbon dioxide is converted to carbon monoxide and the sulfur dioxide is converted into hydrogen sulfide, with further enrichment by the gases of pyrolysis.

There are obvious limits of effectiveness in the Russian system of linkage. A practical limit is established in maximum well spacing due to the requirement of initially injecting the oxidizer in all directions from the injection well. A distant second well might never receive enough oxygen for ignition. Should the path of least resistance between the wells happen to be a path near the top of the seam, flame override and all of its attendant problems are sure to occur. Also in wet coal seams the path of least resistance to air flow normally will be above the water, a situation that sets the stage for flame override.

When a coal seam is an aquifer of significance, it is necessary to lower the water table in the coal. Percolation of water through the coal is quite slow and lowering the water table in a uniform manner is virtually impossible when using pumps to withdraw the water. By placing pumps in sumps below the coal seam the water table can be lowered to the bottom of the seam in the immediate vicinity of the well bore. Water will remain at an angle of repose away from the well bore, and at a point some distance from the well bore, the localized water table can be several feet above the bottom of the coal seam.

In this case of residual water residing in an uneven water table, the path of least resistance to air flow normally is a path that overrides the water. In attempting linkage between two wells using the reverse burn procedure, the resultant linkage channel will stray considerably from the bottom of the seam.

It is possible to substantially remove the free water in a coal seam using procedures as described in U.S. Pat. No. 2,973,811 of Rogers. The methods of Rogers provide for injecting gas such as air into the aquifer under such pressure as necessary to drive the water out of the area of influence. Such pressures are considerable higher than those used in the Russian procedures of linkage, although a certain amount of water displacement occurs in the Russian procedure.

A reasonable amount of free water remaining in a coal seam is beneficial to the reactions of coal gasification, therefore driving all of the free water out of the coal to be gasified is not desirable. Water reacts with hot coal to form carbon monoxide and hydrogen, two desirable gases with heat contents exceeding 300 BTU per standard cubic feet. Water driven out of a coal seam can be made to return by slacking off on pressure. The rate of return, however, is generally too slow to be of commercial interest. Thus it is preferable to leave most of the water in the seam provided linkage can be accomplished at or near the bottom of the seam.

Another method of linkage that is independent of the water content of coal is described in U.S. Pat. No. 4,062,404 of Pasini et al. A well is drilled some distance away from the intended reaction zone and the well is deviated until the bore encounters the underground coal in a direction substantially parallel to the seam. Directional drilling continues along the bottom of the seam for the desired distance planned for the reaction zone. The circuit is completed by drilling a vertical well to intercept the bottom of the deviated hole. Such an arrangement provides a channel at or near the bottom of the seam, but has the disadvantage of difficult and costly drilling procedures.

Still another method of linkage is described in U.K. Pat. No. 756,852 of Montagnon which provides for establishing a permeable channel with a flow of electric current between two points in the coal seam. The flow of electric current is somewhat analogous to the flow of air, in that the current will flow through the path of least electrical resistance. Coal, being a non-homogeneous rock, has unpredictable paths of electrical circuits. Over long distances between electrodes the likelihood increases for the path to stray substantially above the bottom of the coal, resulting in a path that promotes flame override.

Flame override can be a serious detriment to successful production of coal in situ. The natural tendency of a fire is to burn upward as long as there is a source of fuel in that direction. The worst case in the reverse burn procedure for linkage occurs when the injected air migrates to the top of the seam and persists in that location until it nears the location of the lower pressure in the ignition well. The burned channel, for the most part, will lie at the top of the seam. Upon burn through and the establishment of a reaction zone, the two wells will appear initially to be performing satisfactorily, with produced gases containing approximately 170 BTU per standard cubic foot. The first sign of trouble is signalled by a steady drop in the BTU content of produced gas. The reaction zone, with no fuel above it, is gradually becoming engulfed in its own ashes. A partial remedy can be applied by significantly increasing the velocity of the gases through the reaction zone, thus picking up the ashes into the flue gas for removal above ground. Such a procedure defeats one of the purposes of in situ gasification of coal; that is, to leave the ash content of the coal underground. Increased velocities of the oxidizer also aggrevates the oxygen by pass problem where combustible gases are subjected to unplanned burning underground with the resultant destruction of combustible gases. Also, attempting to burn an underground fire downward is something other than a rewarding task.

From the foregoing it is apparent that successful gasification of coal in situ requires reaction zones that begin at the bottom of the coal seam. In this mode the fire has the preponderence of the fuel supply above it and the ashes fall out of the path of the fire as it seeks new fuel. Also from the foregoing it is apparent that a lengthy reaction zone is desirable because the reducing environment portion of the underground channel provides the setting for generation and recovery of combustible gases. In the Russian procedures for linkage and establishment of reaction zones, well spacing is generally limited to short distances in the order of 70 feet. Greater distances between wells is desirable from an economic point of view as well as the desirability of having a longer distance for a reducing environment in the underground channel. Well spacings greater than that of the Russian procedures would provide more favorable economics and provide a setting for improved performance of the in situ reactions. Such lengthened spacing requires a correspondingly effective linkage procedure.

In U.S. Pat. No. 4,010,801 of the present inventor, methods are taught wherein a blind hole burn in coal creates underground channels and reaction zones for the production of coal in situ. The procedures of the present invention extend the teachings of U.S. Pat. No. 4,010,801 to include methods of linking two or more wells by burning channels along the bottom of the coal seam.

SUMMARY OF THE INVENTION

Two wells are drilled from the surface of the earth into and through a coal seam. The wells are hermetically sealed and an oxidizer injection tubing is lowered into each well together with a whipstock. The whipstock is capable of making a 90° bend in the oxidizer injection tubing. The whipstock is set in each case so that the oxidizer injection tubing emerging from the whipstock is aligned toward the opposite well. The coal is set afire and the fire is propagated by an oxidizer injected through the oxidizer injection tubing. The oxidizer is tempered with water vapor to control maximum temperatures of the fire and to provide cooling to the oxidizer injection tubing. Additional oxidizer tubing is inserted in each well as the channel is lengthened through the coal. Linkage between the two wells is thus attained.

DESCRIPTION OF THE PREFERRED EMBODIMENTS

Figure 1:
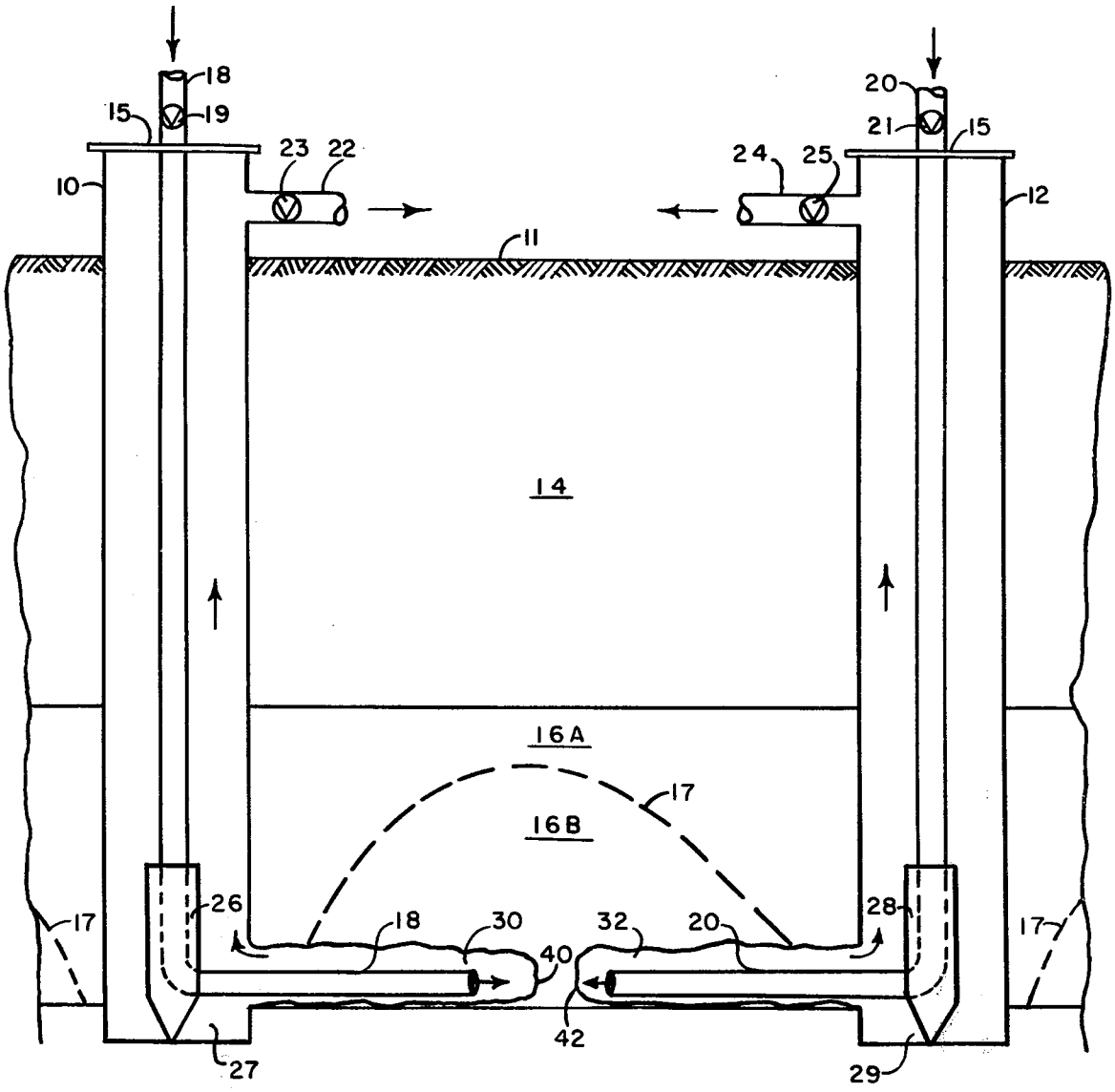
FIG. 1 is a diagrammatical vertical section showing the arrangement of apparatus for the methods of the invention.

Referring to FIG. 1, two wells 10 and 12 are drilled from the surface of the earth 11 through overburden 14, through coal seam 16 and forming sumps 27 and 29 in the underburden. The wells are hermetically sealed, for example by setting a casing to the top of the coal seam 16. A suitable closure 15 is affixed to the well casing. Into well 10 an oxidizer injection tubing 18 is inserted with whipstock 26 emplanted in sump 27 so that the oxidizer injection tubing 18 is bent at an appropriate angle, for example 90°, and the portion of oxidizer injection tubing 18 emerging from whipstock 26 is pointing toward well 12. Initially oxidizer injection tubing will emerge from whipstock 26 only a short distance, for example 2 inches, while the illustration of FIG. 1 shows the oxidizer injection tubing near the final stages of the linkage procedure. Oxidizer injection tubing 18 contains valve 19 for regulation of flow of the oxidizer. Well 10 has fluid withdrawal pipe 22 with valve 23, which permits the products of reactions to be withdrawn from the underground reaction zone and provides a means of applying back pressure control.

Likewise well 12 contains oxidizer injection tubing 20 containing valve 21 with whipstock 28 emplaced in sump 29. Whipstock 28 is set so that tubing 20 is pointed toward well 10 as it emerges from the whipstock. Well 12 has fluid withdrawal pipe 24 which contains valve 25.

Prior to initiating the linkage procedure it is preferred that water withdrawal pumps (not shown) be temporarily installed in sumps 27 and 29 and that the water table be lowered to the bottom of the coal seam in the vicinity of the production wells 10 and 12. When the water table is thus lowered the boundary of the water table 17 is distorted from its normal position. Coal 16A is substantially dry of free water and Coal 16B retains a considerable amount of free water within its void spaces. Such free water in Coal 16B provides a reasonably effective barrier to the migration of gases through the coal. Should linkage between wells 10 and 12 be attempted using the reverse burn technique, the linkage channel tends to occur in Coal 16A above the water table boundary 17. Such a linkage channel deviating a considerable distance above the bottom of the seam considerably reduces the overall efficiency of the underground burn.

After the water table has been lowered in the vicinity of wells 10 and 12 and the oxidizer injection tubings 18 and 20 have been positioned into whipstocks 26 and 28 as previously described, the linkage procedure of the present invention can be initiated. The procedure begins in well 10 by placing suitable ignition material in the lower portion of well 10, for example by opening closure 15 and dropping incandescent charcoal briquettes into the hole. Closure 15 is then returned to its sealed position and oxidizer injection is begun through oxidizer injection tubing 18. While any convenient ignition procedure may be used in the practice of the present invention, by way of example hot charcoal briquettes are used in sufficient quantity to contact the coal seam adjacent to the lower end of tubing 18. By continuing the injection of oxidizer, for example air, through tubing 18, coal 16 will reach its ignition temperature at a location in the path of the oxidizer blast in a relatively short time, for example approximately two to five minutes. Once the coal seam is ignited in a localized area, a channel through the coal is initiated. The channel 30 away from well 10 is lengthened by continuing injection of oxidizer through tubing 18, and by periodically inserting more length to tubing 18 so that the bottom end of tubing 18 remains in reasonable proximity to the burning end 40 of channel 30. In this manner channel 30 may be lengthened from the well bore of well 10 along the bottom of coal 16 for considerable distance, for example as much as several hundred feet. In some cases it may be practical to terminate channel 30 at or near the well bore of well 12, and thus preclude the necessity of initiating a second channel from well 12. Preferably, however, channel 30 is propagated to a point near the midpoint between wells 10 and 12.

In a like manner channel 32 is propagated toward well 10 from well 12 by igniting the coal at the well bore of well 12 and injecting oxidizer through tubing 20. Tubing 20 is lengthened into well 12 as channel 32 is burned toward well 10 and the lower end of tubing 20 is kept in reasonable proximity of burning end 42 of channel 32. Preferably channel 32 is propagated to a point near the midpoint between wells 12 and 10.

Figure 2:
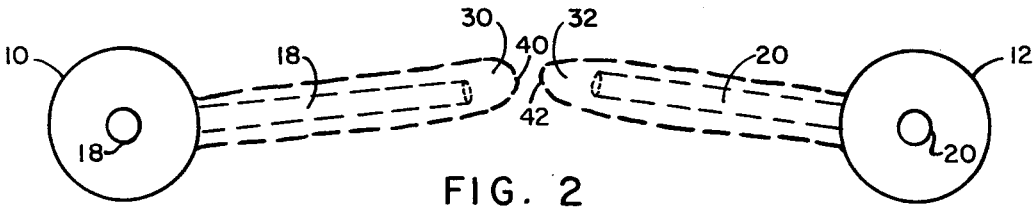
FIG. 2 is a diagrammatic plan view of a well pattern and the underground linkage channels.

It is desirable that channel 30 and channel 32 be propagated until they merge, however it is not necessary that their paths be aligned so precisely. As illustrated in FIG. 2, channels 30 and 32 were imperfectly aligned. As a practical matter the channels may be aligned so that they do not intersect, yet the channels may be joined by an alternate procedure. For example, during the burning of channel 30, oxidizer is injected into tubing 18 and the products of reaction are withdrawn through withdrawal pipe 22. Likewise during the burning of channel 32, oxidizer is injected through tubing 20 and the products of reaction are withdrawn through withdrawal pipe 24. The coal around channels 30 and 32 is at pyrolysis temperature as a result of the underground fires and such coal is giving off the gases of pyrolysis. In a shrinking coal, the permeability of the coal adjacent to channels 30 and 32 is significantly increased. Thus when channels 30 and 32 are burned to points near each other, an alternate procedure can be employed to complete the linkage between burning ends 40 and 42. With the increased permeability in the coal between burning ends 40 and 42 due to pyrolysis, linkage can be completed, for example, by closing valves 19 and 25 and continuing oxidizer injection through tubing 20. Preferably the oxidizer injection pressure is increased, for example an increase in the range of 20% to 200%, in order to provide excess oxidizer. With this arrangement the burn in channel 32 will continue as a forward burn toward channel 30 and the burn in channel 30 will propagate as a reverse burn toward channel 32 until the two channels burn together, thus completing the linkage between wells 10 and 12.

It is preferred that the temperatures in the reaction zones of channels 30 and 32 be controlled to avoid severe damage to the metal parts installed in wells 10 and 12. Generally the temperatures should be in the range of above the ignition temperature of the coal, for example approximately 800° F., to a maximum range of about 1200° F. The maximum temperature of incandescent coal is generally about 2000° F. without flames. This temperature can be lowered to the preferred maximum range of about 1200° F. by injecting appropriate quantities of water into the reaction zone. Such injection of water preferably is done as a mixture of water and oxidizer injected through tubing 18 and 20. Such injection of a mixture of water and oxidizer will keep tubing 18 and 20 sufficiently cool to avoid significant damage to the tubing. Preferably tubing 18 and 20 is of relatively small diameter, for example less than 2", so that they may be properly bent in whipstocks 26 and 28.

Preferably oxidizer injection pressures are kept at relatively low levels, for example in the order of two atmospheres, although the pressures required will vary from site to site. For example in deep seams the hydraulic pressure of the water in Coal 16B may be sufficiently high that water encroachment into burning channels 30 and 32 becomes a problem. The reaction zones in channels 30 and 32 can be destroyed by quenching if encroachment water is permitted to enter the channels in sufficient volumes to reduce the temperature below that required for reaction of fluids with the coal. Thus control is required to limit encroachment of water into the reaction zones. Such control can be applied by increasing oxidizer injection pressures in tubing 18 and 20 while holding back pressure with the proper adjustment of values 23 and 25. By maintaining the pressure in channels 30 and 32 above that of the hydraulic head pressure, water can be excluded from the channels. By maintaining the pressure in the channels slightly below hydrostatic head pressure, free water in Coal 16B can be permitted to enter the channels and thus provide a measure of temperature control in the reaction zones. Such controlled water encroachment can serve as an alternate to injecting water with the oxidizer through tubing 18 and 20.

The emplacement of whipstocks 26 and 28 can be done in several ways. In one method tubing 18 is inserted into whipstock 26 prior to lowering into well 10, with a small length of tubing 18 emerging from the whipstock, for example 2" of tubing protruding outside of the whipstock. A stopper is inserted in the protruded end of tubing 18, such stopper serving as a temporary barrier to fluids entering tubing 18. The assembled unit of whipstock 26 and tubing 18 is lowered in well 10 until the whipstock reaches the bottom of sump 27. The assembled unit then is aligned so that the protruding tubing is pointed toward well 12. A suitable sealant, for example portland cement, is poured into sump 27 and allowed to set. Once the whipstock is thus emplaced, oxidizer is injected into tubing 18 with sufficient pressure to dislodge the stopper, thus permitting ignition and initiation of channel 30. In this method whipstock 26 becomes a permanent installation in well 10, and upon completion of the linkage procedure remains in well 10 as an expendable item.

It is important that tubing 18 and 20 be sufficiently rigid to withstand the compressive forces required to insert additional lengths of tubing into wells 10 and 12 through whipstocks 26 and 28. It is also important that tubing 18 and 20 be sufficiently flexible to be capable of bending through whipstocks 26 and 28 without causing failure to the tubing.

Looking now to well 10 as an example, once the burning of channel 30 is initiated, the hot gases from the reaction zone of channel 30 will significantly raise the temperature of whipstock 26 and tubing 18 located near the bottom of well 10. Such increase in temperature will facilitate the bending of tubing 18 through whipstock 26. Such increase in temperature also lessens the rigidity of tubing 18 between the whipstock and the well head. When the increase in temperature expected to be encountered within well 10 is sufficient to alter the regidity of tubing 18 to the point that the tubing tends to buckle, an alternate procedure should be used in emplacing whipstock 26.

Figure 3:
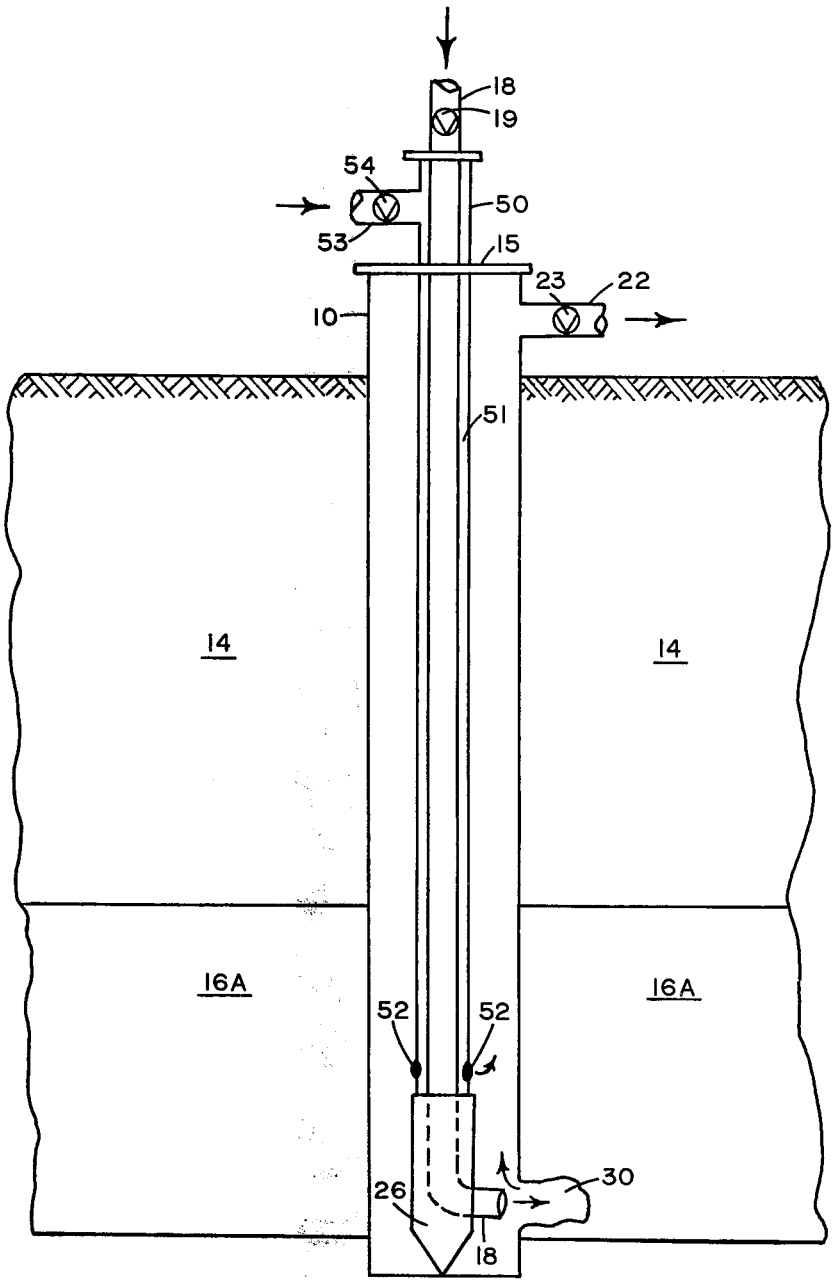
FIG. 3 is a diagrammatical vertical section showing a well equipped for the methods of the invention.

In the alternate emplacing procedure (FIG. 3) a protective pipe 50 is affixed to whipstock 26, such pipe being of larger diameter then tubing 18 so that an annulus 51 is formed between tubing 18 and the protective pipe 50. While it is preferable that all of the tubing to be used as tubing 18 be in one piece, the protective pipe can be in several joints. The first joint of the protective pipe is affixed to whipstock 26 and preferably the protective pipe contains perforations 52 located immediately above whipstock 26. Thus the assembly to be lowered into well 10 contains the whipstock affixed to the protective pipe, tubing 18 inserted into whipstock 26 with a portion of tubing 18 protruding through the whipstock. The assembly is lowered into the well with extra joints of the protective pipe being added as the assembly is lowered. Once the whipstock reaches the bottom of sump 27, the assembly is aligned so that protruding tubing 18 is pointed toward well 12. The protective pipe is equipped with a water injection pipe 53 containing valve 54 and is hermetically sealed at the well head. Once channel 30 is initiated and the temperature of the protective pipe increases substantially, for example up to 250° F., water is injected into the annulus between tubing 18 and the protective pipe with the water flowing out of the perforations in the lower end of the protective pipe. Water flow into the annulus preferably is controlled so that upon exit through the perforation it is in the vapor phase. In this manner the rigidity of tubing 18 can be preserved between the whipstock and the well head.

Maintaining rigidity of tubing 18 between whipstock 26 and its lower end near burning face 40 is not a critical consideration, although some measure of rigidity should be maintained to assure that tubing 18 is capable of being lengthened as burning face 40 recedes into the coal. The cooling effect of the injected oxidizer, particularly when water is mixed with the oxidizer, is generally sufficient to maintain the required measure of rigidity for additional lengths of tubing 18 to be inserted into lengthening channel 30. A measure of flexibility of tubing 18 located in channel 30 is desirable in that by gravity tubing 18 will tend to remain close to the interface between the coal and the underburden. Thus by maintaining the oxygen release point at the bottom of the coal, channel 30 will lengthen at the preferred location. By emplacing the whipstock using a protective pipe affixed to the whipstock, upon completion of the linkage procedure, the whipstock can be removed from the wall.

Using the methods of the present procedure, two wells several hundred feet apart can be linked through the coal, with the linkage channel substantially following the bottom of the coal seam. As a practical matter, however, lengths of the linkage channel should be limited. While it is desirable to have linkage channels sufficiently long to provide an adequate length for a reducing environment, excessive lengths result in the ultimate lowering of the temperature of produced fluids to a point where condensible liquids accumulate in the channel. Excessive accumulations of condensed heavy liquids such as tars can severely restrict the flow of fluids through the underground channels, and in extreme cases the channels can become plugged. Generally the distance between wells should be limited to a maximum distance in the order of 300 feet.

Thus it may be seen that positive control may be applied in the linkage of two production wells with the channel through the coal being formed substantially at the bottom of the coal seam, that such linkage may be accomplished by removing only a part of the free water contained in the coal, and that the problem of flame override can be substantially eliminated by accomplishing such linkage.

While the present invention has been described with a certain degree of particularly, it is understood that the present disclosure has been made by way of example and that changes in detail of structure may be made without departing from the spirit thereof.

What is claimed is:

1. A method of linking two spaced apart production wells drilled through an underground coal seam wherein the linkage is accomplished substantially at the bottom of the underground coal seam in preparation for producing the coal in situ, comprising the steps of establishing a hermetic seal in each of the spaced apart production wells, the hermetic seal being between the underground coal seam and the surface of the earth, establishing an oxidizer injection conduit from the surface of the earth through an emplaced whipstock located at the bottom of a first production well, aligning the oxidizer injection conduit emerging from the whipstock toward a second production well, the emerging oxidizer injection conduit being positioned substantially at the bottom of the underground coal seam, and the emerging oxidizer injection conduit being aligned substantially parallel to the interface between the underground coal and the underburden, establishing an oxidizer injection conduit from the surface of the earth through an emplaced whipstock located at the bottom of the second production well, aligning the oxidizer injection conduit emerging from the whipstock in the second wall toward the first production well, the emerging oxidizer injection conduit being positioned substantially at the bottom of the underground coal seam, and the emerging oxidizer injection conduit being aligned substantially parallel to the interface between the underground coal and the underburden, igniting the coal seam in the first production well, igniting the coal seam in the second production well, injecting an oxidizer through the oxidizer injection conduit in the first production well with the resultant burning of a first channel in the path of the oxidizer blast, injecting an oxidizer through the oxidizer injection conduit in the second production well with the resultant burning of a second channel in the path of the oxidizer blast, inserting additional length of oxidizer injection conduit into the first production well with the resultant movement of the oxidizer release point moving in consonance with the retreating burning face of the first channel through the underground coal, inserting additional length of oxidizer injection conduit into the second production well with the resultant movement of the oxidizer release point moving in consonance with the retreating burning face of the second channel through the underground coal, continuing injection of the oxidizer into the first well and into the second well until the channel in the first well merges with the channel in the second well.

2. The method of claim 1 wherein the oxidizer is oxygen.

3. The method of claim 1 wherein the emplaced whipstock in the first production well is positioned at the bottom of the hole comprising the steps of inserting the oxidizer injection conduit into and through the whipstock with the end of the oxidizer injection conduit protruding from the whipstock a sufficient distance to complete the bend in the oxidizer injection conduit, affixing a protective pipe to the whipstock, the protective pipe being a larger diameter than the oxidizer injection conduit with the resultant creation of an annulus between the protective pipe and the oxidizer injection conduit, lowering the assembly comprising the whipstock, the oxidizer injection conduit and the protective pipe until the whipstock is landed at the bottom of the well bore, and aligning the protruding oxidizer injection conduit toward the second production well.

4. The method of claim 3 further including the steps of establishing perforations in the protective pipe, the perforations being positioned adjacent to the whipstock, injecting water into the annulus between the protective pipe and the oxidizer injection conduit, and withdrawing water from the annulus through the perforations and into the wellbore.

5. The method of claim 1 wherein the fluids generated by the propagation of the underground channels are withdrawn from the first production well and from the second production well.

6. The method of claim 8 wherein the oxidizer is mixed with water, the said mixture being injected into the propagating channel in the underground coal.

7. The method of claim 1 wherein the water is apportioned to maintain the maximum temperature in the propagating channel in the range of 800° F. to 1200° F.

8. The method of claim 1 wherein the oxidizer is air.

9. A method of linking two spaced apart production wells drilled through an underground coal seam wherein the linkage is accomplished substantially at the bottom of the coal seam in preparation for producing the coal in situ, comprising the steps of establishing hermetic seals in each of the apaced apart production wells, the hermetic seals being between the surface of the earth and the underground coal seam, establishing an oxidizer injection conduit from the surface of the earth through an emplaced whipstock positioned at the bottom of a first production well, aligning the oxidizer injection conduit emerging from the whipstock toward a second production well, establishing an oxidizer injection conduit from the surface of the earth through an emplaced whipstock positioned at the bottom of a second production well, aligning the oxidizer injection conduit emerging from the whipstock emplaced in the second production well toward the first production well, igniting the coal seam in the first production well, igniting the coal seam in the second well, injecting oxidizer through the oxidizer injection conduit in the first production well with the resultant propagation of a first channel through the coal seam, injecting oxidizer through the oxidizer injection conduit in the second production well with the resultant propagation of a second channel through the coal seam, terminating oxidizer injection in the first production well, continuing oxidizer injection into the second production well until the first channel and the second channel merge.

10. The method of claim 9 wherein the oxidizer is air.

11. The method of claim 9 wherein the oxidizer is oxygen enriched air.

12. The method of claim 9 wherein the oxidizer is oxygen.

13. The method of claim 9 wherein water is mixed with the oxidizer.

14. The method of claim 13 wherein the water is apportioned to maintain the maximum temperature in the propagating channels in the range of 800° F. to 1200° F.

* * * * *